United States Patent [19]

Matsumoto

[11] 3,967,119

[45] June 29, 1976

[54] CORONA CHARGING DEVICE

[75] Inventor: Seiji Matsumoto, Asaka, Japan

[73] Assignee: Rank Xerox Ltd., London, England

[22] Filed: July 16, 1974

[21] Appl. No.: 489,011

[30] Foreign Application Priority Data

Dec. 30, 1970 Japan ..... 45-122493

[52] U.S. Cl. ..... 250/326; 250/324; 317/262 A

[51] Int. Cl.[2] ..... G03G 15/02

[58] Field of Search ..... 250/324, 325, 326; 317/262 A

[56] References Cited

UNITED STATES PATENTS

| | | | |
|---|---|---|---|
| 3,303,401 | 2/1967 | Naumann et al. | 250/324 |
| 3,390,266 | 6/1968 | Epping | 250/326 |
| 3,649,830 | 3/1972 | Sato | 250/326 |
| 3,655,966 | 3/1972 | Takimoto | 250/324 |
| 3,689,767 | 9/1972 | Sato et al. | 250/326 |
| 3,729,649 | 4/1973 | Chappelle | 250/326 |
| 3,800,153 | 3/1974 | Matsumoto et al. | 250/325 |
| 3,811,048 | 5/1974 | Matsumoto et al. | 250/324 |

*Primary Examiner*—Alfred E. Smith
*Assistant Examiner*—B. C. Anderson
*Attorney, Agent, or Firm*—Robert J. Bird

[57] ABSTRACT

A corona charging apparatus including a corona electrode and a surface to be charged, and a corona discharge control line, which may be insulative or conductive, and grounded or impressed with a voltage located adjacent to the corona electrode. The relative geometry of electrode and control line is variable, both angularly and spatially to control the charge pattern deposited on the surface.

6 Claims, 2 Drawing Figures

CORONA CHARGING DEVICE

BACKGROUND OF THE INVENTION

This invention relates to a charging device to be employed in electrostatic photography.

As is well known, it is a common practice in electrostatic photography that a photoconductive insulating layer provided on a somewhat electrically conductive substrate is uniformly charged to form a "photosensitive layer", the photosensitive layer is thereafter exposed to light to form a latent electrostatic image thereon, and the latent image is developed employing electroscopic powders or "toners". In the above mentioned charging process, it is required that the substrate be connected to ground. However, it has been found heretofore that a substrate having a good flexibility is rather difficult to ground at a low resistance, and for this reason, it is difficult to charge the photoconductive layer uniformly. This is especially so when the substrate is made of polyester or triacetate resin film or other resin film, paper or resin coated paper, all of which are difficult to make conductive in the direction of their thickness.

Although it is a common practice that a photoconductive layer supported on such a substrate is electrically charged with its peripheral portion being grounded, the central portion of the photoconductive layer tends to be insufficiently charged because of the comparatively high grounding resistance.

In order to compensate the above described phenomenon and to obtain uniform distribution of the electrical charges, some measure must be taken to collect a further amount of electrical charges to the central portion of the photoconductive layer.

Furthermore, in electrostatic photography, there exists a problem of "edge effect" which causes thick peripheral portions and thin central portions in the image thereby developed. To compensate this "edge effect", it is required to collect more charges on the central portion of the image so that a uniform density is obtained throughout the image. In the case where a negative developing method is employed, an image of uniform density may also be obtained by reducing the amount of the electric charges at the central portion.

Therefore, a principal object of the present invention is to provide a charging device capable of collecting more electric charges on some part of a photosensitive surface than on another part thereof, or to charge the surface uniformly.

A method of charging a sheet-formed material is known, wherein an electrically conductive wire of a diameter ranging from 20 to 100 microns is employed as a corona discharging electrode (hereinafter called a corona wire), a high voltage is applied to the corona wire to cause corona discharge therearound, and the sheet-formed material is passed adjacent the corona wire to be charged with electrical charges.

Another method is also known wherein a conductive wire of a larger diameter than the corona wire is placed near the corona wire, and uniform distribution of electrical charges are accumulated on the sheet material.

All of these methods, however, were proposed for the purpose of obtaining a more uniform corona discharge.

According to the present invention, there is provided a corona charging device wherein a wire having a larger diameter than that of the corona wire and made either of an electric conductor, insulator, or insulator coated conductor (hereinafter called a discharge control line) is provided near the corona wire, and the discharge control line is disposed not in parallel to the corona wire but is varied in its distance from the corona wire, whereby the intensity of the corona discharge is partly varied, and the distribution of the electrical charges on the photosensitive layer is thereby controlled.

The nature, principle, and utility of the present invention will be more clearly understood from the following detailed description when read in conjunction with the accompanying drawing.

DRAWING

DESCRIPTION

Figure 1:
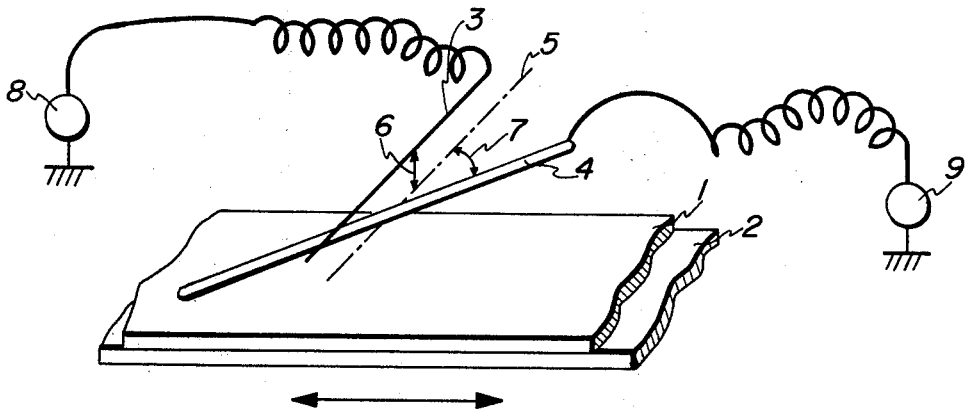
FIG. 1 is a schematic diagram showing the principle of the present invention.

Referring now to FIG. 1 showing the principle of this invention, 1 designates a sheet material to be charged such as electrostatic photographic paper having a photoconductive insulating layer. 2 designates a conveyor for transporting the sheet 1 in the indicated direction below the charging device. 3 designates a corona wire disposed in a plane parallel to the sheet material 1 to be charged, and is made of tungsten, molybdenum, stainless steel, or the like of a diameter ranging from 20 to 100 microns. Numeral 4 designates a discharge control line made of a conductive wire of a diameter ranging from 100 microns to 5 mm, or a conductive wire coated with an insulating material. The cross-sectional configuration of these wires may be a circle, ellipse, or any polygon having angle portions thereof being rounded. Although the discharge control line 4 is disposed in a plane parallel to the surface of the sheet material 1 to be charged, the line 4 does not contact the corona wire 3, and is disposed offset therefrom so that the line 4 is not in parallel to the corona wire 3. The shortest distance between these wires is preferably selected in a range of 5 to 20 mm. Numeral 5 designates an imaginary line which is a perpendicular projection of the corona wire 3 to a plane including the control line 4 and being parallel to the sheet material 1. Numeral 6 designates a distance from the intersect point of the control line 4 and the imaginary line 5 to the corona wire 3, and numeral 7 designates an angle between the imaginary line 5 and the discharge control line 4, which is preferably selected in a range of from 2° to 45°. 8 designates a voltage source for the corona wire 3, the voltage of which is selected in a range of 3 to 20 KV d.c., or is selected to a value consisting of an a.c. superimposed on a d.c. voltage so that a peak voltage of 3 to 20 KV is attained. Under the application of this voltage, corona discharge is caused around the corona wire 3.

The corona discharge is much influenced by an object at a voltage, such as control line 4, placed nearby the corona wire 3. The discharge is much intensified when the voltage difference between the two members is large, and the discharge is suppressed when the voltage difference therebetween is small. Furthermore such influence is amplified when the distance between the corona wire 3 and the control line 4 is shorter. Numeral 9 is a voltage source for the discharge control line 4.

In the example shown in FIG. 1, the discharge control line 4 is made of a conductor, and this may be directly grounded or applied with a voltage from the voltage source 9. When the voltage thus applied is small or when the control line 4 is directly grounded, the corona discharge from the corona wire 3 is intensified at a portion thereof where it is located near the control line 4. Accordingly, the central portion of the corona wire 3 discharges corona more intensely than the end portions thereof, and the sheet material 1 placed under the corona wire 3 will receive more electric charges on its central portion.

When the angle 7 formed between the corona wire 3 and the discharge control line 4 is made larger, the region receiving the intensified discharge of electric charges on the sheet material 1 will be narrowed, and when the angle 7 is made smaller, the region of the sheet material 1 will be expanded. Likewise, if the distance 6 between the two lines is made shorter, the difference between the intensified portion and the unintensified portions of the corona discharge will be exaggerated, and if the distance 6 is made longer, the difference will be reduced.

Thus, when the sheet material is exposed to the corona discharge partly intensified as described above, the sheet can be non-uniformly or unevenly charged when it is so desired.

In the case where the discharge control line 4 is made of an insulating wire or of a conductor coated by an insulating substance, the control line 4 has deposited thereon corona ions from the corona wire 3 so that the potential of the control line 4 will be elevated. Accordingly, if the control line 4 of this kind is placed near the corona wire 3, the corona discharge thereof will be suppressed because a body having a less potential difference is placed near the corona discharge wire 3. The matter will be the same if the discharge control line 4 is made of a conductor and applied with a high potential of the same polarity.

As compared to the case where the discharge control line 4 is made of an insulating material, a conductor coated with an insulating material, or of a bare conductor applied by a high potential of the same polarity as that of the corona wire (more than a half of the voltage applied), in the case where the discharge control line 4 is made of a conductor applied with a low voltage or connected to the ground or applied with a voltage of the different polarity from that of the corona wire, the above described influence to the charging on the sheet material will be just reversed.

When the discharge control line 4 is disposed in an adjustable position as shown in FIG. 1, the corona discharge in the central portion thereof can be easily controlled, and the amount of electrical charges in the corresponding portion of the sheet material can be controlled. This enables one to control the extent of strongly and weakly charged regions and also the difference in the charging intensity in these regions.

The corona wire 3 should have a sufficient length to cover the whole width of the area to be charged on the sheet material 4. However, the wire 3 is not necessarily disposed perpendicular to the direction of movement of the sheet material 1, but it may be disposed obliquely within a range of 0° to 60°.

The discharge control line 4 controls the discharge condition depending on the deflecting angle relative to the corona wire 3, and it is not necessarily disposed between the corona wire 3 and the sheet material 1 to be charged.

In fact, the discharge control line 4 can be disposed above or sidewise of the corona wire 3 so long as it is located near the corona wire, and there may be any number of control lines 4.

The corona discharge electrode represented by the corona wire 3 is not always limited to the form of wire, but the electrode may be constructed in the form of needle electrodes or a knife-edged electrode. In these cases, since the corona discharge occurs at the tip or the needles of the knife-edge, the tip of the row of needles or the knife-edge should be disposed in a locus in place of the corona wire.

Figure 2:
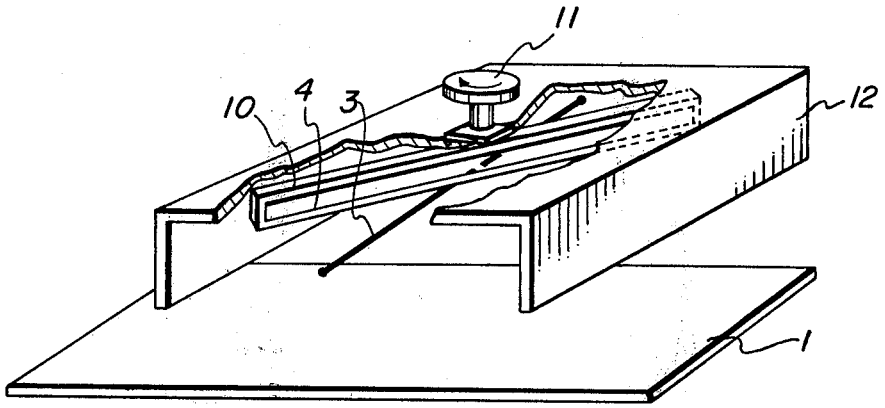
FIG. 2 is a diagramatic perspective view of a corona charging device accordng to the present invention.

In FIG. 2, there is indicated an embodiment of the present invention, wherein the same or like members are designated by like reference numerals. In addition, numeral 10 designates an arm-member supporting the discharge control line 4, numeral 11 designates a knob for adjusting the position of the discharge control line 4, and numeral 12 designates a shielding member.

In this embodiment, the discharge control line 4 is arranged above the corona wire 3, and the line 4 supported by the arm member 10 may be rotated or moved up and down by means of the adjusting knob 11 in a predetermined range, whereby the angle and the distance between the discharge control line 4 and the corona wire 3 can be adjusted to desired values.

As described above, according to the present invention, the corona wire itself is maintained in a stationary state without being displaced or deformed, and by simply providing a discharge control line, which can be adjustable as to its relative position and angle against the corona wire, a uniform distribution of electric charges or a desired distribution thereof can be obtained on a sheet material, on which it has been difficult to attain the uniform distribution of electrical charges.

What is claimed is:

1. A corona charging apparatus for applying electrostatic charge to a charge surface including:

a corona electrode disposed along a line in spaced relation to said charge surface and operatively connected to a source of voltage for the creation of corona and corona current to accumulate electrostatic charge on said charge surface a control wire disposed along a line in spaced relation to said corona electrode and at an oblique angle relative thereto so that successive increments of said control wire along the length thereof are differently spaced from said corona electrode, said control wire being selectively operatively connected to a source of voltage and to ground, whereby the presence of said control wire at varying distance from said corona electrode exerts variable effect on the corona current flowing therefrom to correspondingly vary the charge density on said charge surface.

2. A corona charging device as defined in claim 1 in which said control wire is a conductive member.

3. A corona charging device as defined in claim 1 in which said control wire is an insulative member.

4. A corona charging device as defined in claim 1 and further including means to vary the angular orientation of said control wire relative to said corona electrode and means to vary the spacing between said control wire and said corona electrode.

5. A corona charging apparatus as defined in claim 1, further including means to vary the spacing between said corona electrode and said control wire.

6. A corona charging apparatus as defined in claim 1, further including means to vary the angular orientation between said corona electrode and said control wire.

* * * * *